US005678654A

United States Patent [19]

Uzawa

[11] Patent Number: 5,678,654

[45] Date of Patent: Oct. 21, 1997

[54] HANGING-SCAFFOLD PANEL AND HANGING SCAFFOLD COMPRISING SAID PANELS

[75] Inventor: Katsuo Uzawa, Chiba-ken, Japan

[73] Assignee: Shinsei Industrial Co., Ltd., Ichihara, Japan

[21] Appl. No.: 494,552

[22] Filed: Jun. 26, 1995

[30] Foreign Application Priority Data

| | | | |
|---|---|---|---|
| Jun. 30, 1994 | [JP] | Japan | 6-171716 |
| Jun. 30, 1994 | [JP] | Japan | 6-171717 |
| Dec. 29, 1994 | [JP] | Japan | 6-338530 |

[51] Int. Cl.[6] ..... E04G 3/00

[52] U.S. Cl. ..... 182/150; 182/130

[58] Field of Search ..... 182/150, 178, 182/82, 179, 130

[56] References Cited

U.S. PATENT DOCUMENTS

| | | | |
|---|---|---|---|
| 1,188,940 | 4/1916 | Burton | 182/179 |
| 1,909,742 | 5/1933 | Bone | 182/150 |
| 3,924,379 | 12/1975 | Hutchinson | 182/178 |
| 4,090,798 | 5/1978 | Barton | 182/178 X |
| 5,195,839 | 3/1993 | Wicklund et al. | 403/12 |

FOREIGN PATENT DOCUMENTS

| | | | |
|---|---|---|---|
| 101683/1990 | 9/1990 | Japan . | |
| 4-59238 U | 5/1992 | Japan . | |
| 2009830 | 6/1979 | United Kingdom | 182/150 |

*Primary Examiner*—Alvin C. Chin-Shue
*Attorney, Agent, or Firm*—Oliff & Berridge

[57] ABSTRACT

A hanging scaffold panel for use in a hanging scaffold has a rectangular frame with an elongate male portion projecting from one side and attached to the rectangular frame with a fixing pin. The rectangular frame has a female portion on a side opposing the male portion and adapted to receive a male portion from an adjoining panel. The elongate male portion has two semi-cylindrical sections that are threadably adjusted to engage the female portion. A fastening pin is used to lock the male portion in the female portion.

3 Claims, 13 Drawing Sheets

HANGING-SCAFFOLD PANEL AND HANGING SCAFFOLD COMPRISING SAID PANELS

FIELD OF THE INVENTION

This invention relates to a hanging-scaffold panel used to erect a scaffold which, in constructing such a structures as an expressway, a bridge or a building, is suspended from the girders or balustrades of such a structure.

This invention also relates to a hanging scaffold which is suspended from the girders or balustrades of an expressway or a bridge. This hanging scaffold is for workmen to stand on and engage in construction or repairing work of such a structure as an expressway or a bridge, or for necessary materials and tools for such activities to be placed on.

PRIOR ART

In the building and civil engineering trades, it is often the case wherein a hanging scaffold is put up, standing thereon workmen are engaged in constructing or repairing work on such a structure as an expressway or a bridge.

Such a hanging scaffold has conventionally been constructed in the following manner:

1. As shown in FIG. 14, while a crane with a workman C standing in is moving in direction shown by arrow, a chain-hanging clamp D is mounted at certain intervals on each of two supporting members A (for example, girders), and then a chain B is hung from each clamp D.

2. A so-called guide pipe or longitudinal member E is put through a chain B already suspended, as shown in FIG. 15, and a skilled workman M, while standing on the longitudinal member E, connects the next neighboring longitudinal member E with the already-suspended longitudinal member E.

3. A so-called sleeper pipe or a horizontal member F is placed across the already-installed longitudinal members E, and is fixedly secured on the already-installed longitudinal members E by means of, for example, an orthogonal clamp G which is conventionally widely used for connecting pipes with each other.

4. A so-called wale pipe or an auxiliary member H is laid perpendicularly in the middle of the horizontal members F, as shown in FIG. 16, and is fastened firmly on the members F by means of, for example, a widely used orthogonal clamp G.

5. As shown in FIG. 17, a scaffolding board J is placed across the horizontal members F, and fastened by means of a wire K onto the horizontal members F.

6. Workmen M, standing on the scaffolding board J, place and fixedly secure additional horizontal members F across between the longitudinal members E which are in front of workmen M, and place and fix an additional scaffolding board J perpendicularly onto the added horizontal members F. This process will be repeated until a desired scale of scaffold is constructed.

7. As shown in FIG. 18, handrails L may be installed on the longitudinal members E, and, as necessity arises, a net N may be laid below the hanging scaffold to prevent things from dropping down, and/or a curing sheet may be covered over the hanging scaffold.

The present inventor earlier invented a hanging-scaffold panel as illustrated in FIG. 9, and there is a hanging scaffold comprising the hanging-scaffold panels, a substitute for the above-mentioned conventional hanging scaffold. The hanging-scaffold panel invented earlier by the present inventor, as shown in FIG. 9, is made up of two basic members (of square pipe) 1 properly separated from each other, between which connecting elements 2*a*, 2*b* and 2*c* are lengthwise and widthwise placed, forming a rectangular frame 3, with supporting metal fittings 16 being mounted at proper intervals onto the inside of each of the basic members 1, and a footboard 4 as of plywood or expanded metal net being placed onto the supporting metal fittings 16.

This scaffold panel can be assembled into a hanging scaffold in the following manner:

1. As shown in FIG. 10, a hanging means such as a chain-hanging clamp D is each mounted at a corresponding point onto each of two supporting members A, and a chain B is hung from the clamp D.

2. The chain B is fastened onto the connecting element (of round pipe) 2*b* or onto a fastening ring 17 of a frame 3 shown in FIG. 9, thus suspending the frame 3 from the supporting members A.

3. Standing on the footboard 4 laid on the frame 3, a workman M as shown in FIG. 11 fixes another clamp D at a point forward on the supporting member A, and sets a chain B onto the additional clamp D.

4. This chain B as shown in FIG. 12 is connected with the connecting element 2*b* or with the fastening ring 17 of another frame 3. As a result, this additional frame 3 is suspended next to the earlier-suspended frame 3.

5. The fitting male portion 14 of the later-suspended frame 3 is inserted into the connecting element (of round pipe) 2*a* of the earlier-suspended frame 3 as illustrated in FIG. 9. A fixing pin 26 is inserted from outside the connecting element (of round pipe) 2*a* into the fitting male portion 14, connecting this fitting male portion 14 with the connecting element (of round pipe) 2*a*, and fixedly securing both the frames 3 together in a direction of the widths thereof.

6. The connecting processes as shown in FIGS. 11–12 are repeated before a hanging scaffold as shown in FIG. 13 is erected.

7. In case a hanging scaffold erected in the manner above mentioned is too narrow, a clamp D is fixed onto another supporting member (not illustrated) neighboring the supporting member A shown in FIG. 10, and a chain B is hung from the clamp D. This chain B is connected onto the connecting element 2*b* or onto the fastening ring 17 of another hanging-scaffold panel, which additional hanging-scaffold panel then being suspended lengthwise next to the earlier suspended hanging-scaffold panel as shown in FIG. 9. This later-suspended hanging-scaffold panel is connected firmly with the earlier-suspended hanging-scaffold panel as shown in FIG. 9 by means of a connecting apparatus (general-purpose orthogonal clamp) 15, forming a desired width of a hanging scaffold.

8. The erected hanging scaffold may be provided with a handrail or covered with a curing sheet as necessity arises in actual use.

PROBLEMS IN THE PRIOR ACT

However, the hanging scaffold as illustrated in FIGS. 14–18 has the following problems:

1. As shown in FIG. 15, a workman, while standing on an earlier suspended longitudinal member E, has to set the next longitudinal member E through a chain B. This is a job only a skilled workman could do and requires a lot of work and time at that. Besides, it is not unlikely for even a skilled workman to miss his footing and fall off the longitudinal member E. Hence there are many big problem involving the safety of workmen.

2. The hanging scaffold necessitates such troublesome activities as laying horizontal members F across the longitudinal members E as shown in FIG. 16, fixing a scaffold board J as shown in FIG. 17, and laying a net for keeping things from dropping below as shown in FIG. 18. These activities require lots of work and time before a hanging scaffold is completed, increasing the cost that much for such extra work and time. Also that much prolonged is the whole spell of construction and repairing work before a hanging scaffold is completed.

3. As shown in FIG. 14, a crane C has to be moved, and this is very much troublesome and laborious. For example, in the bridge construction work of an expressway, the moving of a crane will necessitate the traffic being blocked off under the bridge being built. This will get in the way of the traffic and cause traffic jams. Meanwhile, it is not always possible to use a crane if the bridge crosses over a river or a pond. In this case, all the work has to be done manually, greatly impairing the efficiency of work and increasing the possibility of danger.

A hanging-scaffold panel as shown in FIGS. 9–13 has no big problems as it is invented by the present inventor in an attempt to remove those problems involving the hanging scaffold shown in FIGS. 14–18. Problems worth mentioning, if any, would be such as the time-consuming attaching job of supporting metal fittings 16 to the basic members (of square pipe) 1 for supporting a footboard 4, and as the footboard 4 being bent or curved at points where supporting metal fittings 16 are not provided, which supporting metal fittings 16 being mounted at intervals only in a direction of the length of the basic members 1. Another problem would be that, in order to connect any two neighboring hanging-scaffold panels with each other lengthwise, the adjoining connecting elements 2*a* at the lengthwise ends of adjoining frames 3 are connected with each other by means of a connecting apparatus (clamp) 15, making it necessary to provide connecting spaces 7 through which tools or devices may drop down during work, developing a possibility of danger. Still another problem might be that workmen standing on a hanging scaffold may stumble upon the connecting spaces 7 or that a barrow's wheel in service on the hanging scaffold may get stuck at the connecting spaces 7.

OBJECT OF THE INVENTION

An object of the present invention is to provide a hanging-scaffold panel that can be easily assembled into a hanging scaffold in a short period even by an unskilled workman, and that ensures improved safety in assembling activities and in other activities on a completed hanging scaffold, this hanging-scaffold panel being simple in structure, low in price, durable in life, and able to be so connected with another hanging-scaffold panel as to form a curved hanging scaffold along the curve of such a structure as an expressway or a bridge being constructed or repaired.

Another object of the present invention is to provide such a hanging scaffold that is free from any space through which tools or other things may drop, and upon which workmen may stumble or a barrow's wheel may get stuck, thus ensuring safety of workmen and easiness with which work on the scaffold is carried out.

SUMMARY OF THE PRESENT INVENTION

In a hanging-scaffold panel according to the present invention, a footboard is laid on a rectangular frame which can be suspended by means of a hanging means such as a chain, with a fitting male portion at one side of the frame and a fitting female portion at the other side of the same frame, and the fitting male portion of one hanging-scaffold panel fitting into the fitting female portion of another hanging-scaffold panel, thus connecting the two hanging-scaffold panels together. The fitting male portion is a combination of two semicylindrical pipes with the inner open side of one semicylindrical piece facing vertically that of another semicylindrical piece, each piece being a half of a round pipe in a different diameter divided lengthwise. This combined pipe, being adjustable in diameter, grows smaller in diameter so as to be able to easily fit into a corresponding fitting female portion. The combined pipe, once fitted into the fitting female portion, increases in diameter so that the outer circumferential surface of the fitting male portion is closely pressed against the inner circumferential surface of the fitting female portion, ensuring a close fit between the fitting male and female portions. The fitting male portion has a connecting opening for a fixing pin to fit into. This connecting opening, when made oblong in the axial direction of the fitting male portion, provides a space allowance within which a hanging-scaffold panel can slide and, at an any point, be fixed so that a plurality of hanging-scaffold panels are combined together into a hanging scaffold in a curved form. Each of the two basic members, part of a frame, has a step lower partial plane cut out inwardly lengthwise in its upper surface so that a footboard is set on it more steadily.

In a hanging scaffold under the present invention, the adjacent connecting spaces of two or more neighboring hanging-scaffold panels are covered with a covering which is fixed by means of arresting pins onto the hanging-scaffold panels.

BRIEF DESCRIPTION OF THE DRAWINGS

FIG. 1(*b*) is an enlarged view of a portion of the hanging-scaffold panel of FIG. 1(*a*);

FIG. 4(*b*) is a side view of the fitting male portion, and FIG. 4(*c*) is a bottom end view of the fitting male portion.

FIG. 8(*b*) is a side view, partially in section, of the arresting pin in use, and FIG. 8(*c*) is a front view, partially in a vertical section, of the arresting pin in use.

DETAILED DESCRIPTION OF THE INVENTION

Figures 1A, 1B:
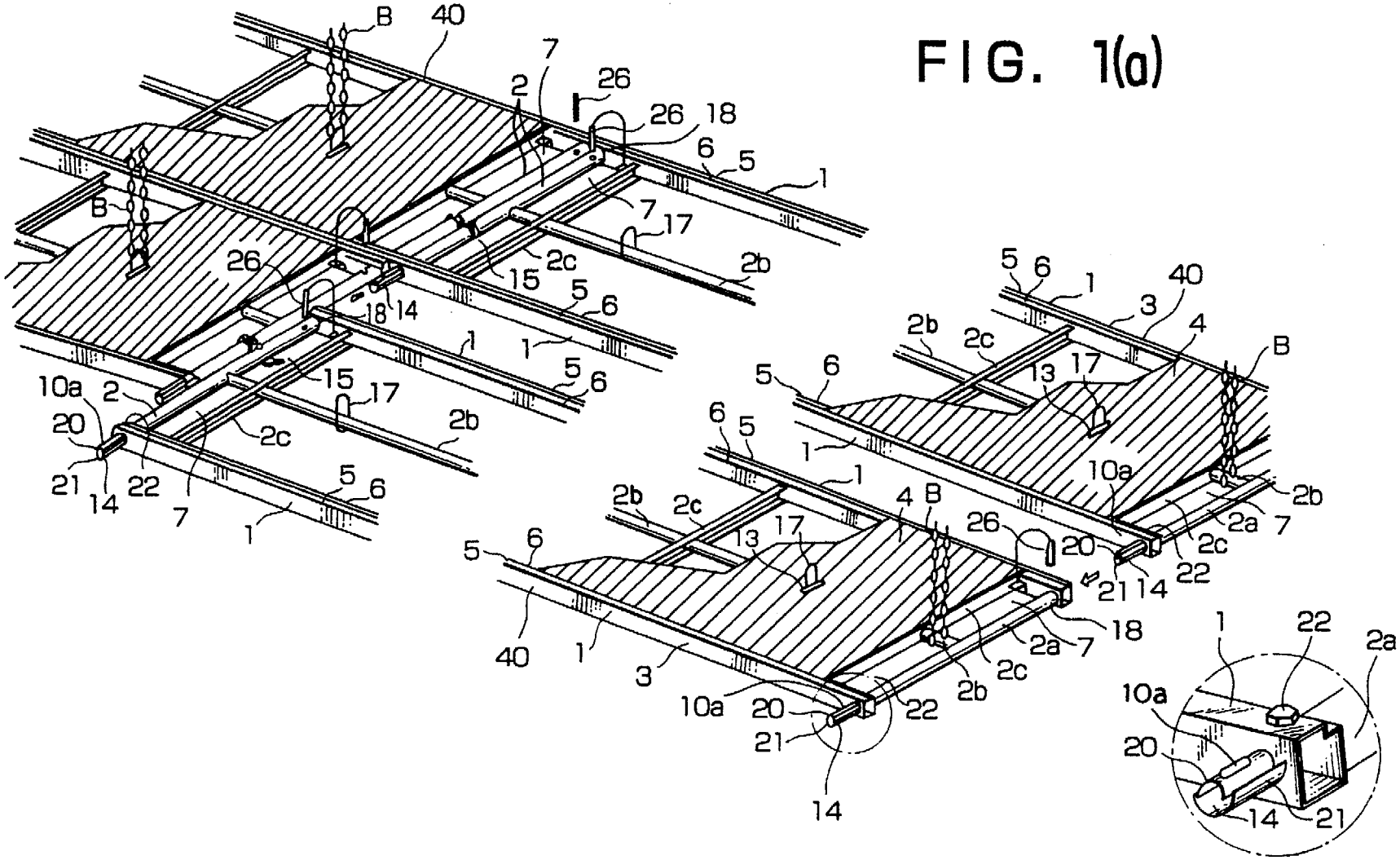
FIG. 1(*a*) is a perspective view showing an embodiment of the hanging-scaffold panel according to the present invention.

An embodiment of the hanging-scaffold panel according to the present invention is described hereinafter, referring to FIGS. 1–4. Reference numeral 3 in FIGS. 1–4 designates a frame. As shown in FIGS 1(*a*) and 1(*b*), the frame 3 comprises the two basic members 1 made of square steel pipe, and set apart side by side at an optional distance from each other; two connecting elements 2*a* made of round steel pipe, each element 2*a* set across the two basic members 1 at each longitudinal end side of the two basic members; a connecting element 2*b* made of round steel pipe, set in the middle between, and in parallel with, the two basic members 1; and two or more connecting elements 2*c* made of steel rod with a ]-shaped section, each connecting element 2*c* set at given intervals across the two basic members 1. The frame 3 is so large a rectangular frame (300 cm long×66 cm wide, for example) that a person can safely stand thereon. The connecting element 2*b* extends over each connecting space 7 to the connecting element 2*a*, this space 7 being provided at each lengthwise end of the frame 3, so that a hanging means B such as a chain can be fastened onto the space-crossing portion of the connecting element 2*b*.

Figure 2:
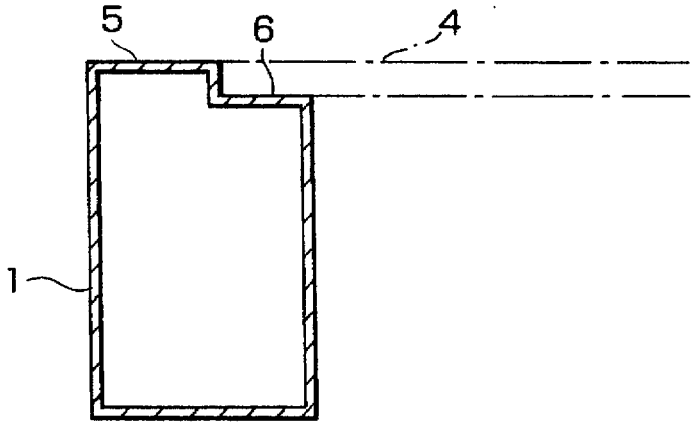
FIG. 2 is a cross-sectional view of a basic member in a hanging-scaffold panel.

As shown in FIG. 2, part of the upper surface 5 of the basic member 1 is cut out inwardly into a degree lower plane which is a footboard-bearing portion 6, along the full length of the basic member 1, this degree of depth being equal to the thickness of a footboard 4 as illustrated in imaginary line in FIG. 2 so that the footboard 4, when placed onto the footboard-bearing portion 6, produces a flush surface with the rest of the upper surface of the basic member 1.

Reference numeral 4 in FIG. 1(*a*) designates a footboard, which is made of plywood as is used for a frame used in casting ready-mixed concrete. The footboard may also be made of expanded metal or any such other materials as steel board. The footboard 4, as shown in FIGS. 1(*a*), 1(*b*) and 2, is supported by the footboard-bearing portions 6 and also by the connecting elements 2*b* and 2*c*, and is securely fixed onto the frame 3 by means of bolts, screws or the like which are not illustrated.

As shown in FIG. 1(*a*), the footboard 4 is provided with a taking-out slot 13 through which a fastening ring 17 fixed on the connecting element 2*b* is lifted up. The fastening ring 17 is designed to be fastened on the hanging means B such as a chain and to suspend a hanging-scaffold panel. Though FIG. 1 shows a frame 3 wherein the connecting space portions 7 are left uncovered, the frame 3 may be covered all over with a footboard, with the connecting space portion 7 covered too.

Figure 3A:
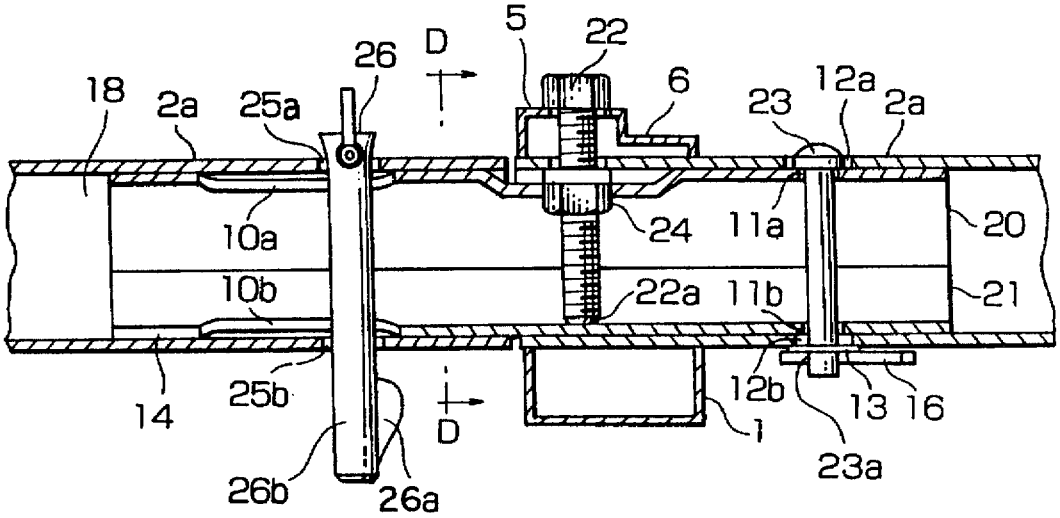
FIG. 3(*a*) is a cross-sectional view of a fitting male portion in a hanging-scaffold panel, and FIG. 3(*b*) illustrates a cross section taken along line D—D in (*a*).
Figure 3B:
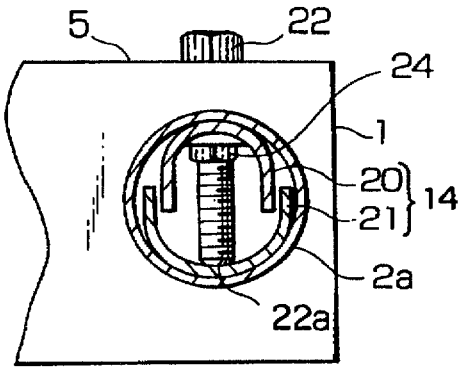
Figure 4A:
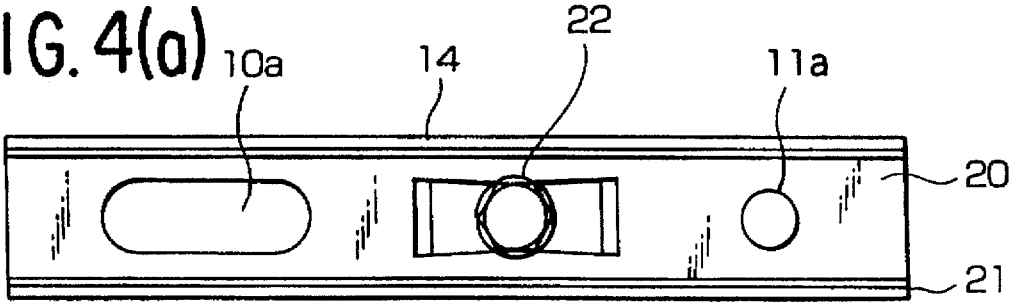
FIG. 4(*a*) is a top view of a fitting male portion used in a hanging-scaffold panel in FIG. 1.
Figure 4B:
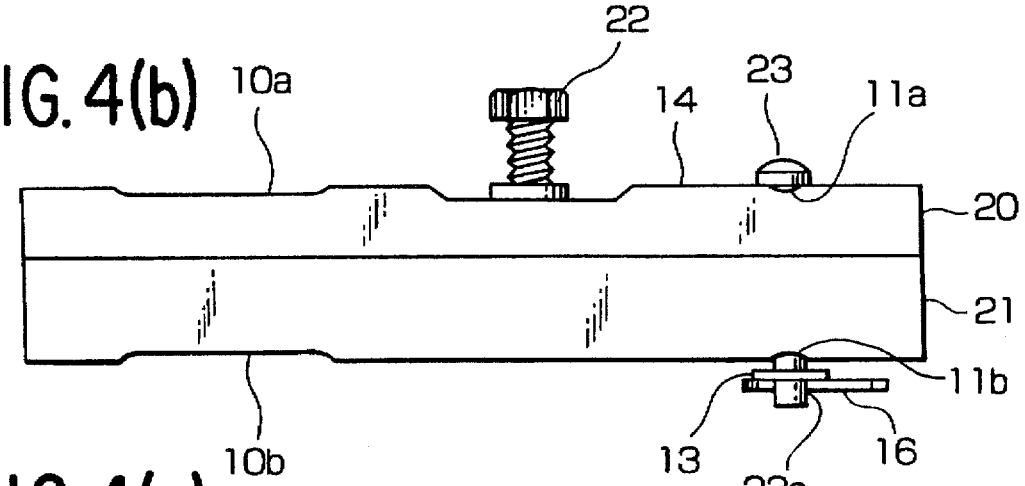
Figure 4C:
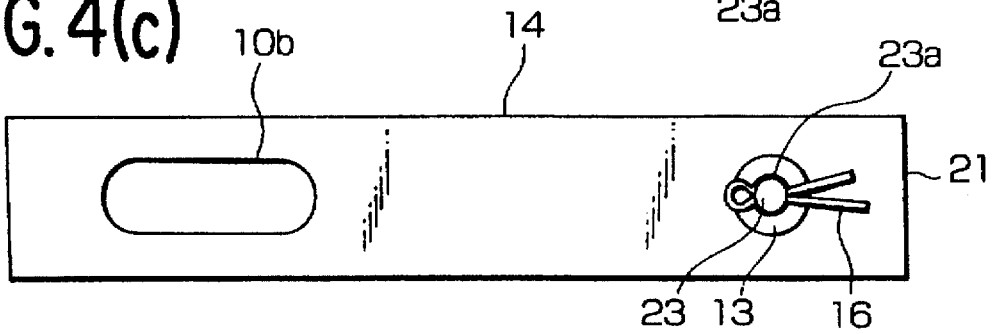

Reference numeral 14 in FIGS. 1(*a*) designates a fitting male portion 14 designed to combine together two neighboring hanging-scaffold panels in a direction with the widths thereof. The fitting male portion 14, as shown in FIGS. 3 and 4, is one combined long pipe of two semicylindrical metal pipes 20 and 21, each semicylindrical metal pipe in a different-radiused U-shaped section (half of a pipe divided lengthwise), and with their open portions set vertically against each other. An adjuster 22 such as a bolt is screwed into a nut 24 securely fixed on the inner circumferential surface of the upper semicylindrical metal piece 20, the lower end 22*a* of which adjuster being in contact with the inner circumferential surface of the lower semicylindrical metal piece 21. The adjuster 22, when turned clockwise, screws down and its end 22*a* pushes the lower semicylindrical metal piece 21 downward, separating this metal piece 21 from the upper semicylindrical metal piece 20 and expanding the outer diameter of the combined pipe, while the adjuster 22, when turned counterclockwise, gets both the upper and lower semicylindrical pieces 20 and 21 closer to each other, reducing the outer diameter of the combined pipe.

The fitting male portion 14, as shown in FIGS. 3 and 4, is provided with an upper insertion round hole 11*a* and a lower insertion round hole 11*b*, one hole in direct opposition to the other, at a point near one end of the length of the fitting male portion 14, and with an upper connecting opening 10*a* and a lower connecting opening 10*b*, these openings being oblong lengthwise, at a point near the other end of the length of the fitting male portion 14.

One end of the fitting male portion 14, as shown in FIG. 1(*a*), is inserted preliminarily into one end of the connecting element (of round pipe) 2*a* of the frame 3 in a direction with the width of the frame 3, and, as shown in FIG. 3, a fixing pin 23 is inserted through the upper through hole 12*a* of the connecting element 2*a*, the upper insertion hole 11*a* and the lower insertion hole 11*b* of the fitting male portion 14, and through the lower through hole 12*b* of the connecting element 2*a*, in this sequence. A washer 13 is put over the portion of the fixing pin 23, which portion sticking out of the lower through hole 12*b*, and a split pin 16 is inserted into a passing hole 23*a* (FIG. 4*b*, *c*). By expanding the split pin 16 to prevent this pin 16 from coming off, one end of the fitting male portion 14 is fastened into one end of the connecting element 2*a* of the frame 3 in a direction of the width of the frame 3.

The other end of the fitting male portion 14, sticking out of one end of the connecting element 2*a*, is ready to be fitted into the fitting female portion 18 (hollow of the connecting element 2*a* or a round pipe) (FIG. 3*a*) of the connecting element 2*a*(of round pipe) of the frame 3 of a neighboring hanging-scaffold panel. As shown in FIG. 3(*a*), the fitting male portion 14 is fitted into the fitting female portion 18, and, upon aligning the locations of the upper connecting opening 10*a* of the fitting male portion 14 and the upper arresting hole 25*a* of the connecting element 2*a*, such a fixing pin 26 as a gravity lock pin is inserted through the upper arresting hole 25*a* of the connecting element 2*a*, the upper connecting opening 10*a* of the fitting male portion 14, the lower connecting opening 10*b* of the fitting male portion 14, and the lower arresting hole 25b of the connecting element 2a, in this sequence, thereby combining together the two neighboring frames 3 of hanging-scaffold panels. Then, the adjuster 22 shown in FIG.3(*a*), when turned clockwise, causes the two semicylindrical metal pieces 20 and 21 to be apart from each other, expanding the outer diameter of the combined pipe, pressing the outer circumferential surfaces of the two semicylindrical metal pieces 20 and 21 against the inner circumferential surface of the connecting element 2a, and thus fastening the combined pipe in the connecting element 2a.

A blade 26a located at the lower end of a gravity lock pin 26 used as a fixing pin, as shown in FIG. 3(*a*), is so designed that the blade 26a is popped out of the lock pin body 26b by the force of a spring (not illustrated) housed within the lock pin body 26b, and can be pushed back into place in the lock pin body 26a by a finger.

Reference numeral 15 in FIGS. 1(*a*) designates a connecting apparatus. This connecting apparatus 15 is designed to combine neighboring suspended scaffoldings in a direction of the lengths of the frames 3. The connecting apparatus 15 may, among others, be a clamp which has conventionally been popularly used for connecting pipes. The connecting apparatus 15, as shown in FIG. 1(*a*), is so designed as to combine the two adjoining connecting elements 2a of the frames 3 of two lengthwise neighboring hanging-scaffold panels. The connecting apparatus 15 may be mounted preliminarily on either of the two connecting elements 2a of adjoining frames 3, or may be mounted at the time of scaffold erection.

Embodiments of a hanging scaffold according to the present invention are described below referring to FIGS. 6–8.

Figure 6:
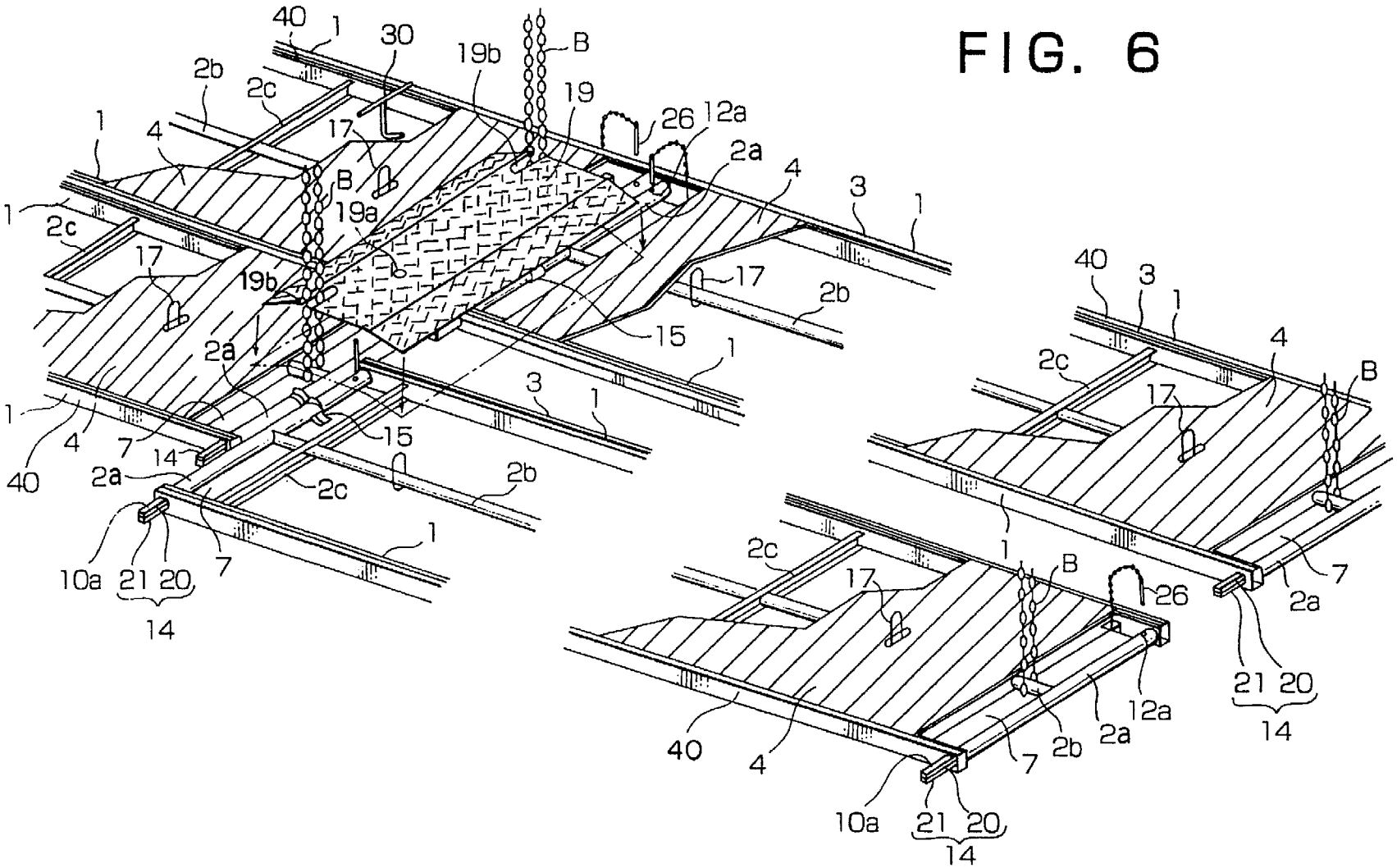
FIG. 6 is a view illustrating another embodiment of the hanging scaffold according to the present invention.
Figure 7A:
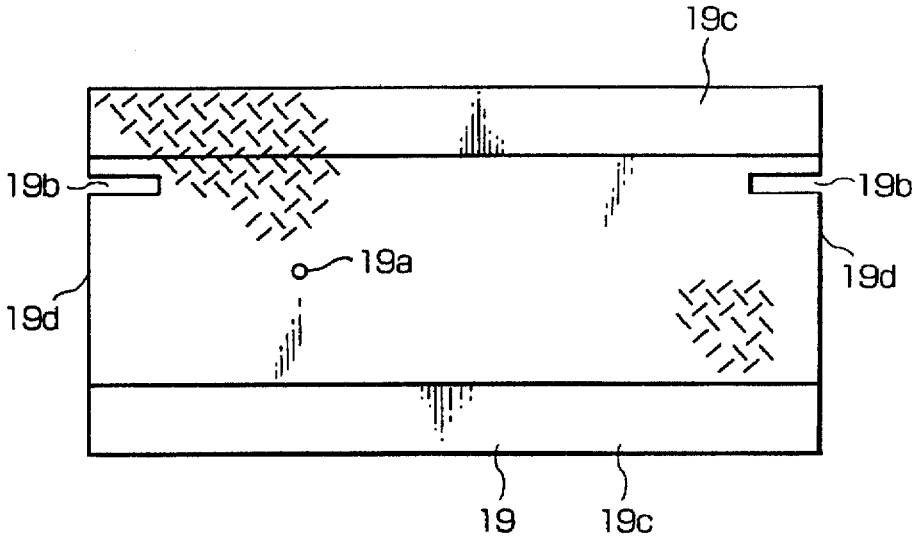
FIG. 7(*a*) is a plan illustrating a covering used in a hanging scaffold embodying the present invention, and FIG. 7(*b*) is a front view of the covering.
Figure 7B:
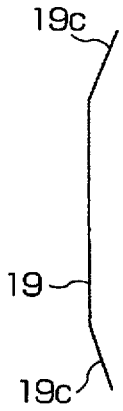

A hanging scaffold shown in FIG. 6 comprises combined hanging-scaffold panels 40 shown in FIG. 1(*a*). Reference numeral 19 in FIG. 6 designates a covering which may be such a high-strength board as of metal or hard resin. The covering 19, as shown in FIG. 6, is a rectangular one large enough to cover as far as the adjoining connecting spaces 7 of two hanging-scaffold panels 40 which are combined with each other lengthwise by means of a connecting apparatus 15. The covering 19, as shown in FIG. 7, is trapezoidal in a side view shown in FIG. (*b*), with both the lengthwise side portions 19c being bent down. One preferred size of the covering 19 is about 760 mm long×393 mm wide in case a hanging-scaffold panel 40 measures 3,000 mm long×661 mm wide.

The covering 19 has an insertion hole 19a of about 16 mm in diameter, located at a point in the middle widthwise but somewhat away from the center lengthwise toward one end of the length of the covering 19. As shown in FIG. 6, the covering 19 is also provided with two taking-out slots 19b, each at each end of the length of the covering 19, through which slot a chain B is taken out. Measuring about 75 mm long and about 20 mm wide, the taking-out slot 19b is open at one lengthwise end thereof at the edge of each lengthwise end of the covering 19, through which slot mouth 19d a hanging means B such as a chain is passed into the taking-out slot 19b.

Figure 8A:
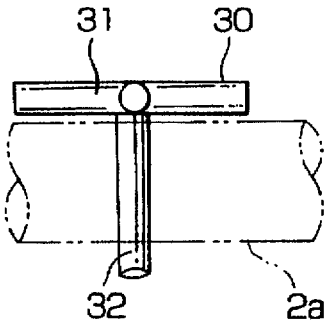
FIG. 8(*a*) is a front view of an arresting pin used in a hanging scaffold under the present invention.
Figure 8B:
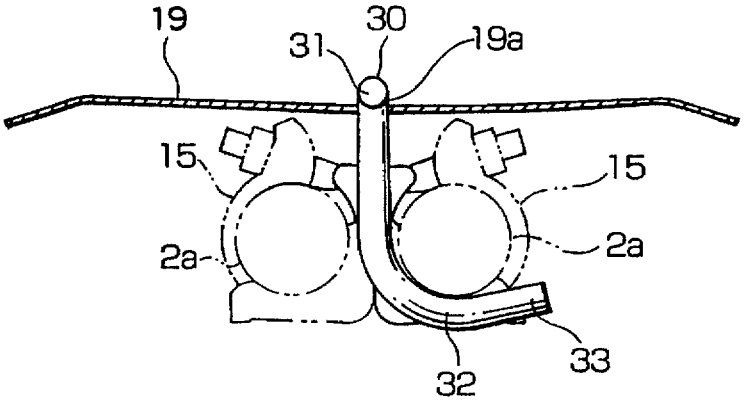
Figure 8C:
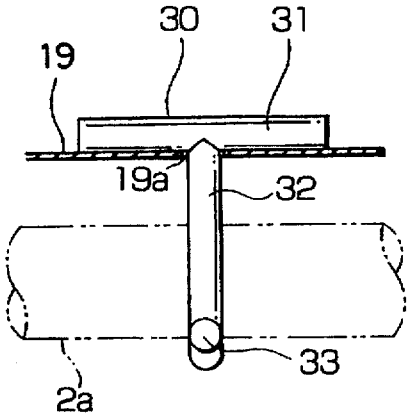
Figure 9:
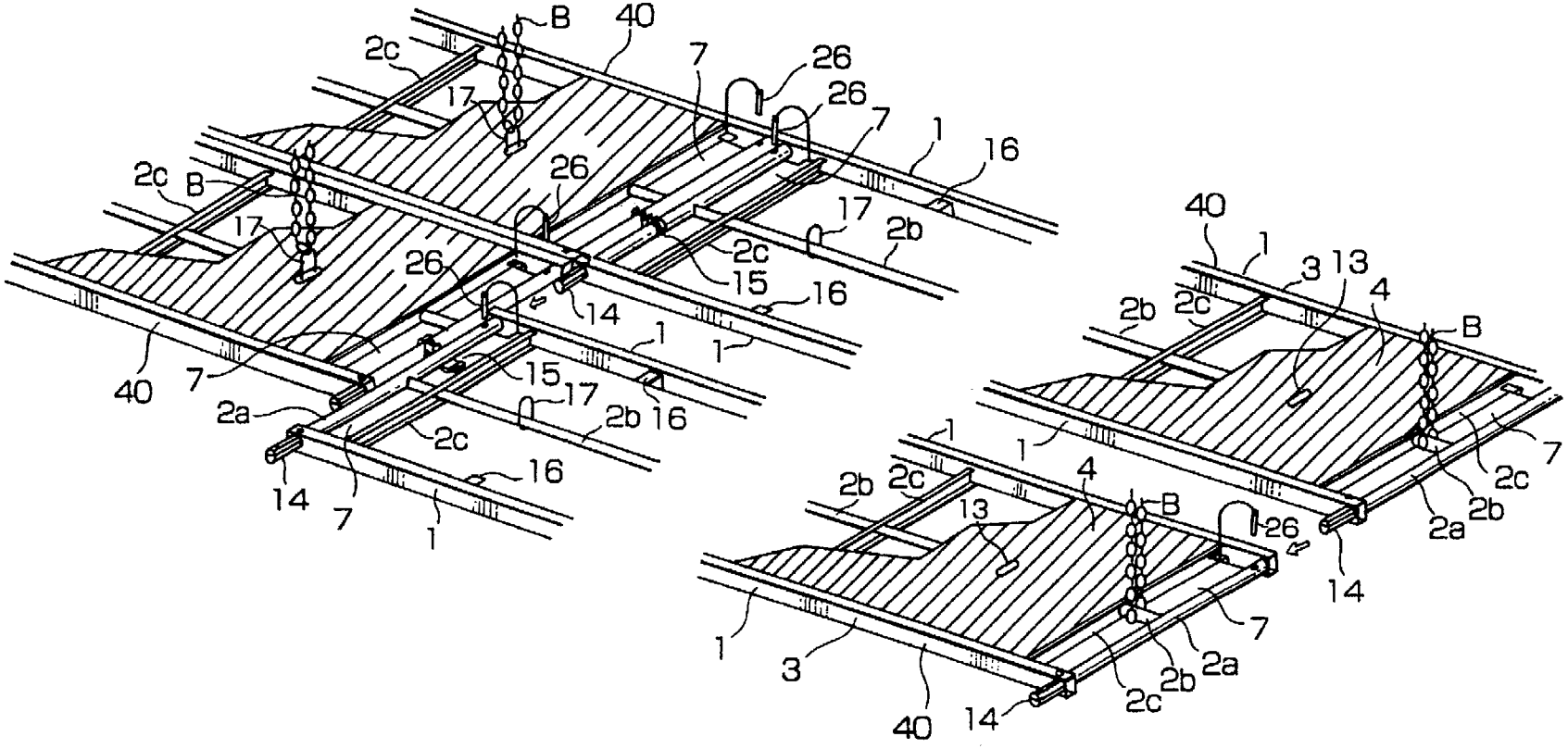
FIG. 9 is a perspective view showing an example of the hanging-scaffold panel invented earlier by the present inventor.
Figure 10:
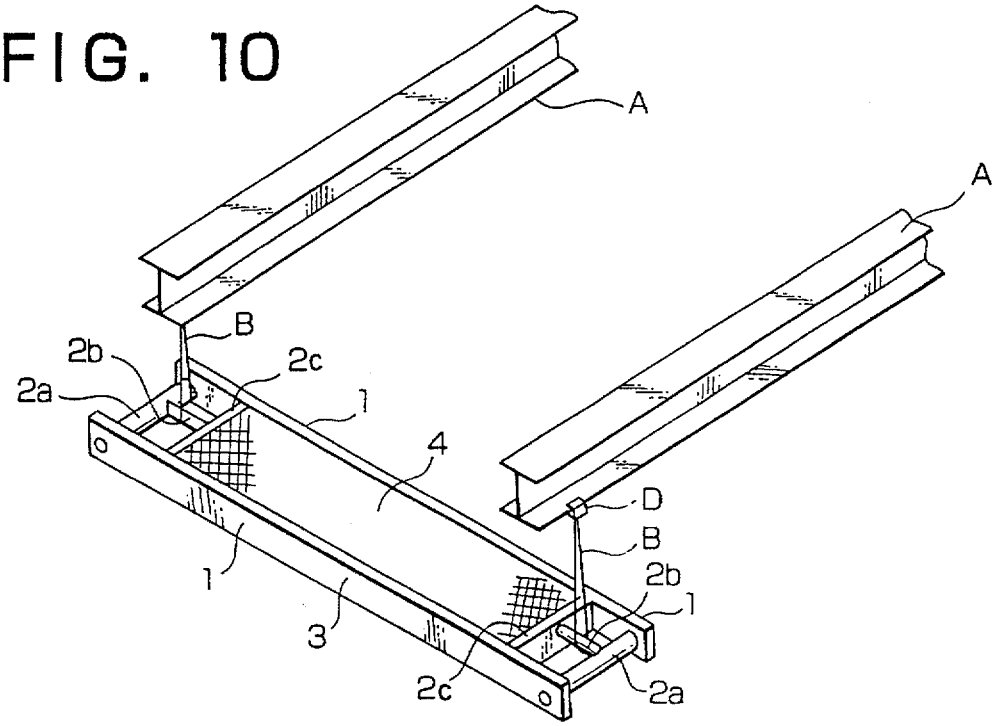
FIG. 10 is a view illustrating the first process of assembling the hanging-scaffold panels in FIG. 9 into a hanging scaffold.
Figure 11:
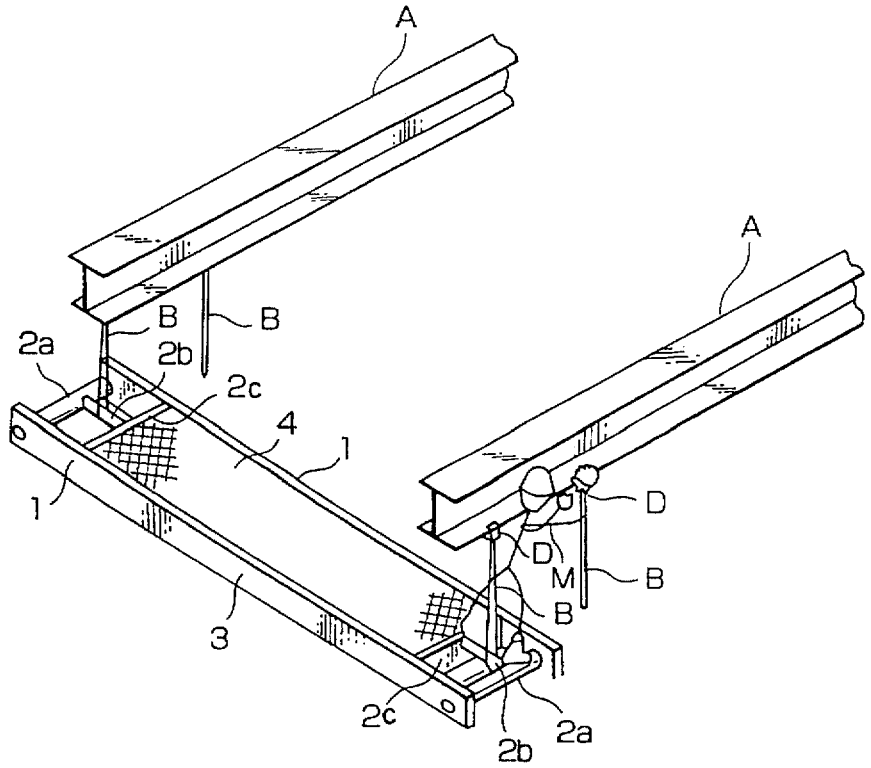
FIG. 11 is a view illustrating the second process of assembling the hanging-scaffold panels in FIG. 9 into a hanging scaffold.
Figure 12:
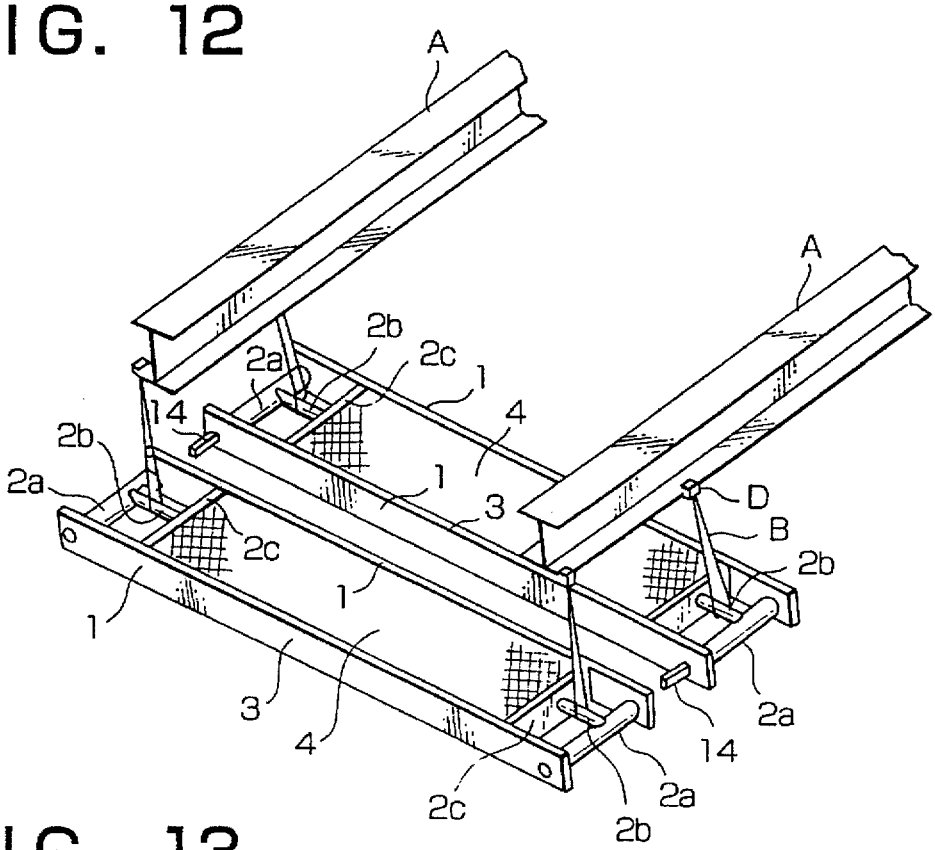
FIG. 12 is a view illustrating the third process of assembling the hanging-scaffold panels in FIG. 9 into a hanging scaffold.
Figure 13:
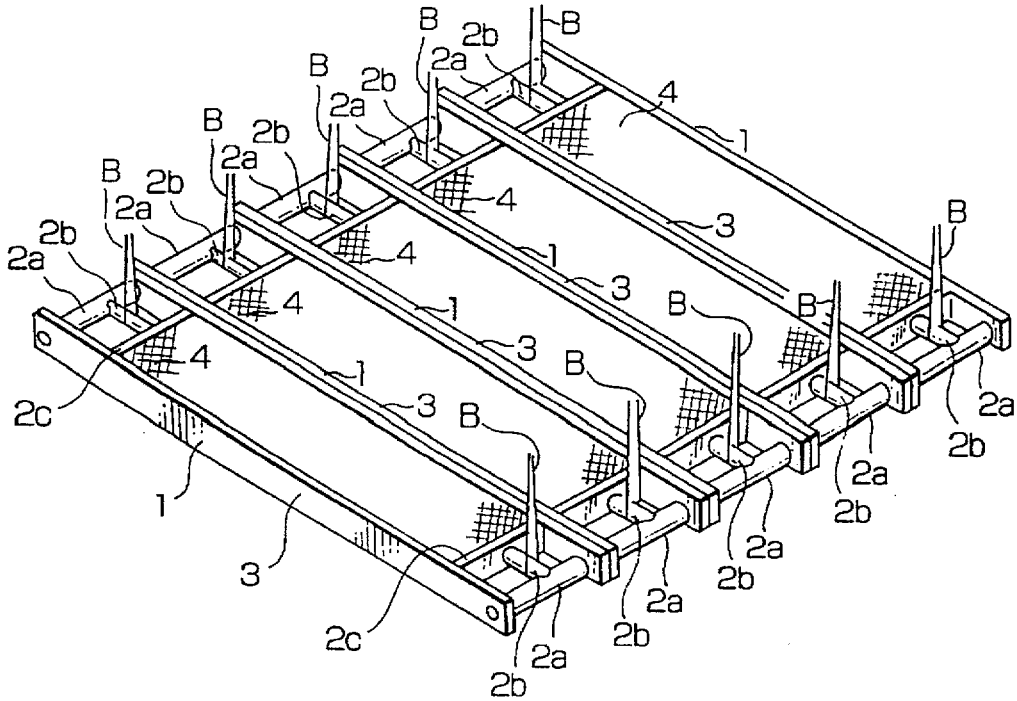
FIG. 13 is a view illustrating the fourth process of assembling the hanging-scaffold panels in FIG. 9 into a hanging scaffold.
Figure 14:
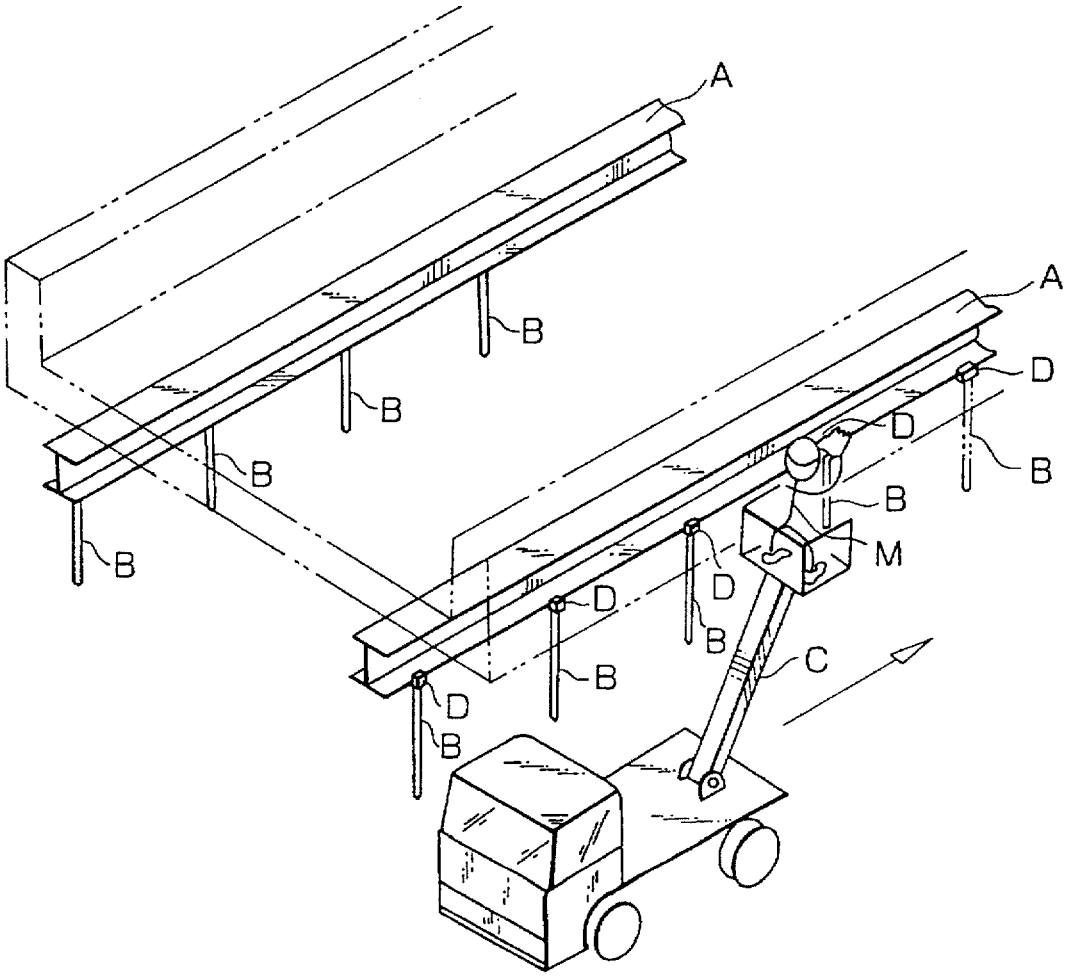
FIG. 14 PRIOR ART
FIG. 14 is a view illustrating the first stage of assembling a conventional hanging scaffold.
Figure 15:
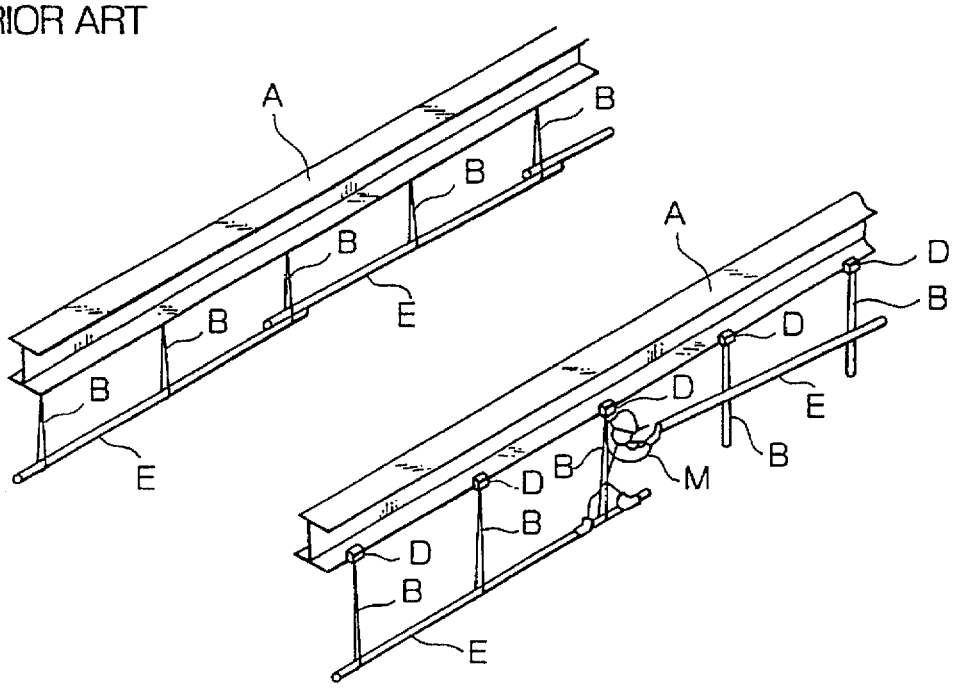
FIG. 15 PRIOR ART
FIG. 15 is a view illustrating the second stage of assembling a conventional hanging scaffold.
Figure 16:
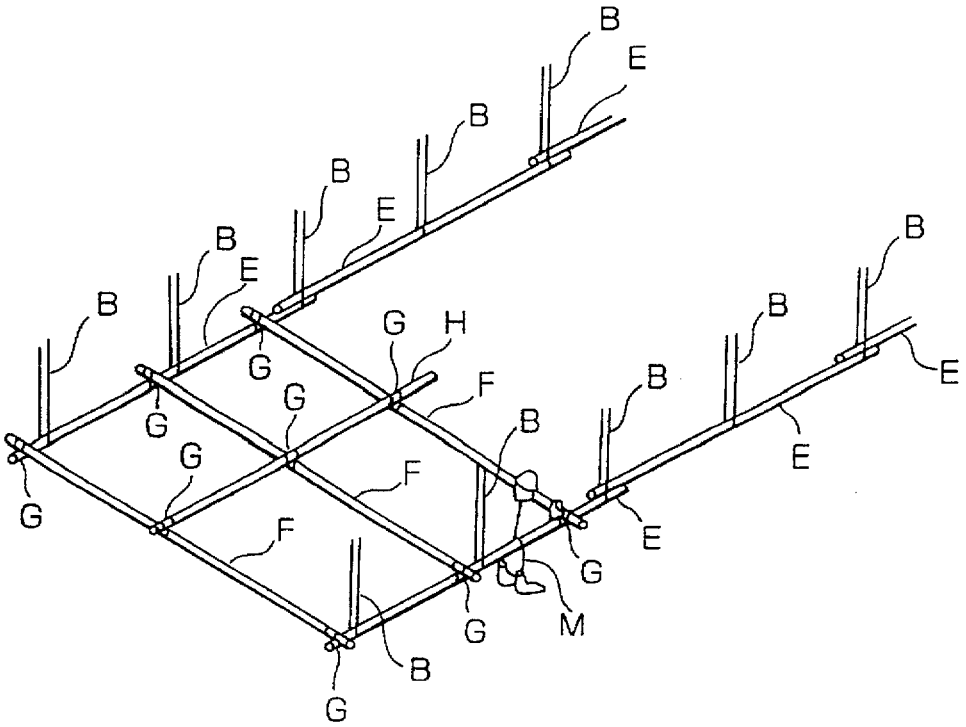
FIG. 16 PRIOR ART
FIG. 16 is a view illustrating the third stage of assembling a conventional hanging scaffold.
Figure 17:
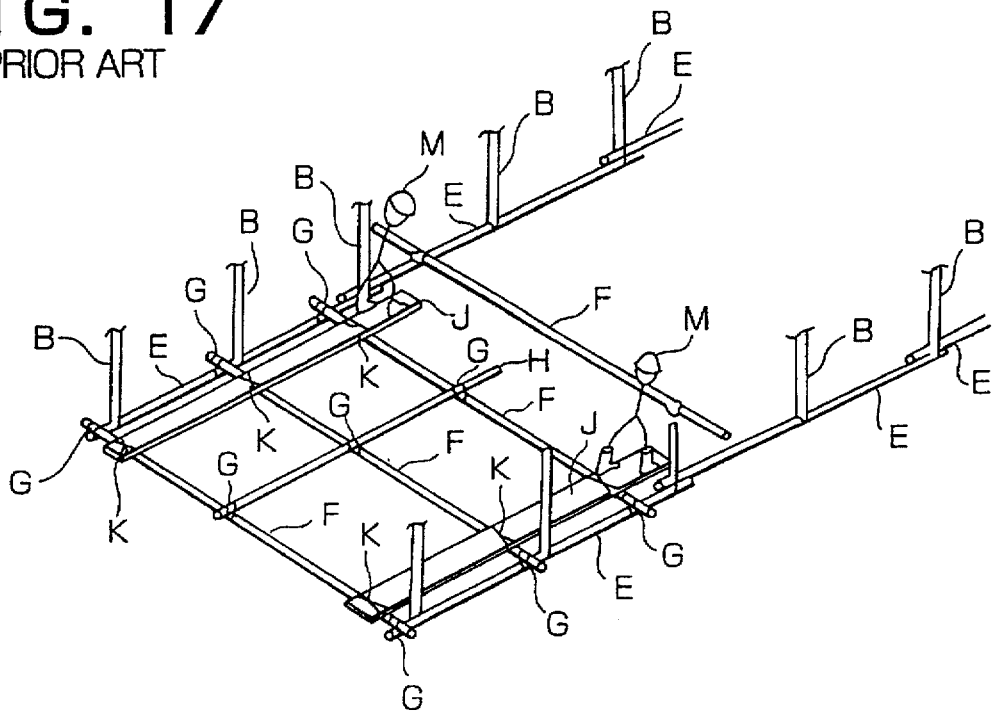
FIG. 17 PRIOR ART
FIG. 17 is a view illustrating the fourth stage of assembling a conventional hanging scaffold.
Figure 18:
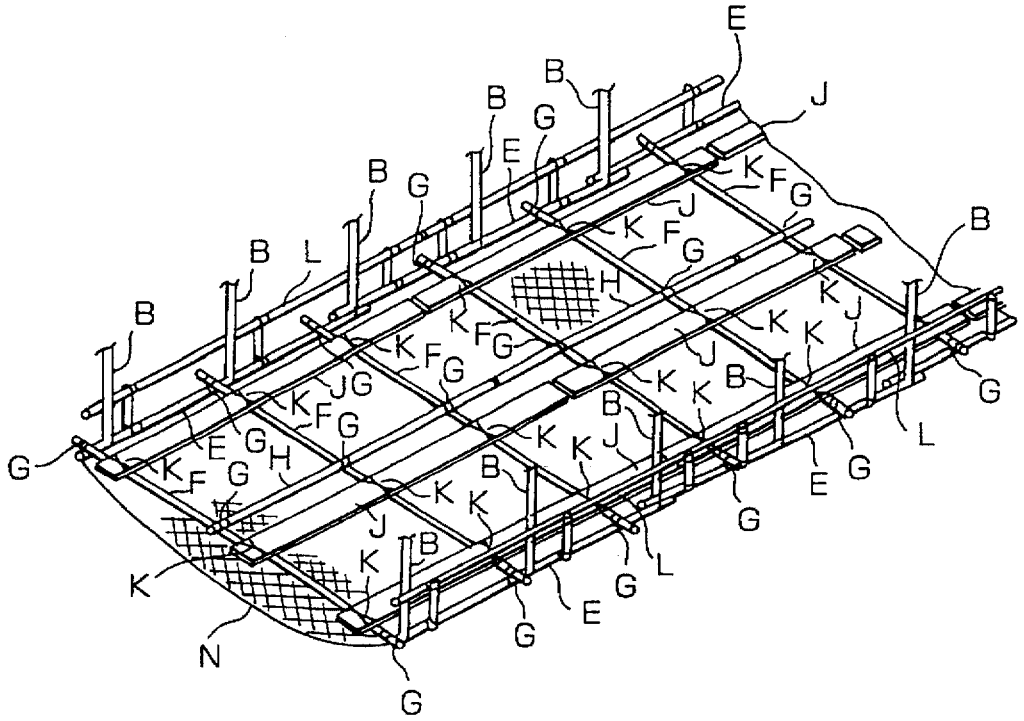
FIG. 18 PRIOR ART
FIG. 18 is a view illustrating the fifth stage of assembling a conventional hanging scaffold.

Reference numeral 30 in FIGS. 6 and 8 designates an arresting pin designed to fix the covering 19 onto the frames 3 of two hanging-scaffold panels 40, the covering 19 being laid over the adjoining connecting spaces 7 of two neighboring hanging-scaffold panels 40. As illustrated in FIG. 8, the arresting pin 30 is made of round metal bar, and takes on a shape of T, with a J-shaped insertion portion 32 being welded in the middle lengthwise of a sideways long handle 31. The insertion portion 32 of the arresting pin 30 can be inserted through the insertion hole 19a of the covering 19. As shown in FIG. 8(*b*), the lower curved portion 33 of the insertion portion 32 is so designed as to be arrested in contact with the bottom surface of the connecting element 2a of a hanging-scaffold panel 40, this element 2a being combined with another element 2a by means of a connecting apparatus 15.

The covering 19 may not be limited to the one previously noted in size and shape, but may be determined according to the size of a hanging-scaffold panel 40 or according to the purpose for which a hanging-scaffold panel 40 is designed. The location or size of an insertion hole 19a provided in the covering 19 may also be freely determined. The position or size of a taking-out slot 19b provided in the covering 19 may also be freely determined according to conditions such as the location of a hanging means B such as a chain.

UTILITY OF THE INVENTION

Described below are examples in use of the hanging-scaffold panel according to the present invention. The hanging-scaffold panel under the present invention is suspended from such a structure as an expressway or a bridge, by arresting a hanging means B such as a chain (FIGS. 1–6), suspended downward from such a structure as an expressway or a bridge, onto the connecting element 2b of the frame 3. In this case, a plurality of hanging-scaffold panels 40 are suspended both lengthwise and widthwise, and neighboring hanging-scaffold panels 40 are combined together both lengthwise and widthwise. In a widthwise combination as shown in FIG. 1(*a*), the fitting male portion 14 of one of any two adjoining hanging-scaffold panels is inserted into the corresponding fitting female portion 18 of the other of the two adjoining hanging-scaffold panels, and such a fixing pin 26 as a gravity lock pin, as shown in FIG. 3(*a*), is inserted through the upper arresting hole 25a of the connecting element 2a, the upper connecting opening 10a of the fitting male portion 14, the lower connecting opening 10b of the fitting male portion 14, and the lower arresting hole 25b of the connecting element 2a, in this sequence, thereby fastening the fitting male portion 14 into the corresponding fitting female portion 18. Then, the adjuster 22 is turned clockwise, expanding the outer diameter of the combined pipe, and causing the outer circumferential surface of the combined pipe to be in contact with the inner circumferential surface of the fitting female portion 18, thus fixedly combining the neighboring hanging-scaffold panels 40.

Figure 5:
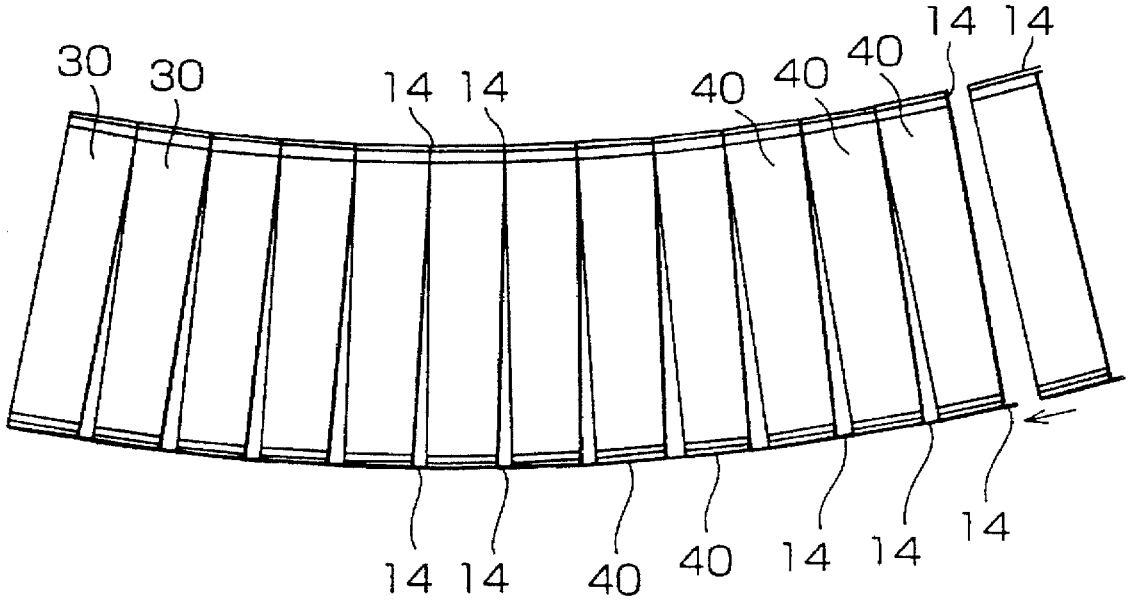
FIG. 5 is a plan illustrating a hanging scaffold, into which hanging-scaffold panels under the present invention are combined together into a hanging scaffold taking on a curved form.

In this case, if the upper connecting opening 10a and the lower connecting opening 10b of the fitting male portion 14 are both a long oblong opening in a direction of the combined-pipe axis, and when a fixing pin 26, as shown in FIG. 3(*a*), is inserted through the upper arresting hole 25a of the connecting element 2a, the upper connecting opening 10a of the fitting male portion 14, the lower connecting opening 10b of the fitting male portion 14, and the lower arresting hole 25b of the connecting element 2a, in this sequence, the left one of the two connecting elements 2a combined together in a direction of the length thereof can be slid along the length of the upper connecting opening 10a and the lower connecting opening 10b. As a result, as shown in FIG. 5, hanging-scaffold panels 40 can be combined together widthwise in a curved form by sliding each outer connecting element 2a and providing a space between two neighboring hanging-scaffold panels 40. In this case, if the upper connecting opening 10a and the lower connecting opening 10b of the fitting male portion 14 at the inner circumference side of the combined hanging-scaffold panels 40 in a curved form, are quite round holes, and when a fixing pin 26 is inserted therethrough to combine any two connecting elements 2*a* as shown in FIG. 3(*a*), the left one of the two connecting elements 2*a* combined together in a direction of the lengths thereof does not slide sideways, thus ensuring a curved form of combined hanging-scaffold panels 40 as shown in FIG. 5.

By combining together the adjoining connecting elements 2*a* of adjoining hanging-scaffold panels 40 by means of a connecting apparatus 15 such as a clamp, hanging-scaffold panels 40 are connected lengthwise with each other as shown FIGS. 1 and 6.

The connecting spaces 7 at one end of two combined hanging-scaffold panels 40 in a direction of the length thereof, as shown in FIG. 1(*a*), may be either left uncovered or covered with a covering 19 as illustrated in FIG. 6. In the latter case, a hanging means B such as a chain is passed through a taking-out slot 19*b*, and, as shown in FIG. 8, the insertion portion 32 of an arresting pin 30 is inserted into the insertion hole 19*a* of a covering 19, with the lower curved portion 33 of the insertion portion 32 being arrested onto the connecting element 2*a* of a hanging-scaffold panel 40, thus fixing the covering 19 onto the hanging-scaffold panels 40.

ADVANTAGES OF THE INVENTION

The hanging-scaffold panel according to the present invention has the following advantages:

1. A rectangular frame has fitting male portions at one side and fitting female portions at the opposite side, into which the fitting male portions of another hanging-scaffold panel can be inserted. As a result, a hanging scaffold can easily be assembled by connecting the fitting male portions of a hanging-scaffold panel with the corresponding fitting female portions of another neighboring hanging-scaffold panel. Therefore, it is possible even for an unskilled workman to efficiently assemble a hanging-scaffold panel, and, while standing on an already-assembled hanging-scaffold panel, to safely engage in connecting the next hanging-scaffold panel with the already assembled one.

2. The outer diameter of the fitting male portion (a combined pipe), being adjustable by an adjuster, can grow smaller so as to be easily fitted into the corresponding fitting female portion, and, once fit, can grow larger so as to press the outer circumferential surface of the fitting male portion against the inner circumferential surface of the fitting female portion, thereby ensuring a close fit between the fitting male portion and the fitting female proportion.

3. Thanks to the formation of mutually connectable fitting male portions and fitting female portions, a hanging-scaffold panel can readily be assembled. An assembled hanging-scaffold panel can also be safely disassembled with ease.

4. A hanging-scaffold panel is of such a simple structured that the manufacture thereof is easy and the cost is low.

5. A hanging-scaffold panel having a plane surface with a square frame on with a footboard is laid, is easy to handle in its transportation and assembling, and, being capable of being piled on top of another, requires a smaller space in its transportation or in storage.

6. The upper connecting opening and lower connecting opening of a fitting female portion are narrow oblong openings in an axial direction of the combined pipe. Therefore, hanging-scaffold panels may be combined together into a hanging scaffold curved along the curves of such a structure as an expressway or a bridge, thus ensuring easiness with which work on such a structure as an expressway or a bridge is carried out.

7. The frame having a footboard-bearing portion in the upper surface, which is a degree lower partial plane cut out inwardly, dispenses with the need for metal fittings on the basic members, which metal fittings being otherwise conventionally required in order to support a footboard laid on a frame, thus affording a simpler frame structure and easiness with which the frame is manufactured. Supported on the full longitudinal lengths of the footboard-bearing portions in the basic members, the footboard, when a workman walks around thereon or members or elements are placed thereon, is hardly bent or curved, thus assuring a high stability and safety thereof.

The hanging scaffold according to the present invention has the following advantages:

1. In a hanging scaffold, any two neighboring hanging-scaffold panels have the two connecting spaces thereof covered by a covering. As a result, the hanging scaffold has no open space therein, getting rid of the possibility of tools or components for work falling through open spaces, thus providing improved safety in activities. The hanging scaffold also having a fairly flush surface, a workman thereon will be free from stumbling and be able to walk around more easily, and a wheelbarrow or the like thereon will not get stuck, thus facilitating activities thereon.

2. A hanging scaffold is hung by a hanging means such as a chain which is passed through a taking-out slot, each located at one mutually opposing widthwise side of a covering. Therefore the hanging means such as a chain, when fastened onto a connecting element in the connecting space of a hanging-scaffold panel, does not get in the way of laying the covering onto hanging-scaffold panel, ensuring a full coverage of the connecting space by the covering.

3. The staking-out slot of a covering being open at one end thereof at the edge of each opposing side of the covering, the hanging means such as a chain can be passed through the taking-out slot even after a hanging-scaffold panel has been suspended, thus ensuring an easiness with which a covering is laid over the connecting spaces.

4. A covering being fixedly secured onto the hanging-scaffold panels by means of an arresting pin, the covering does not move or get dislocated or get out of place because of vibrations, thus ensuring safety.

We claim:

1. A hanging-scaffold panel comprising:

a rectangular frame having an elongate male portion projecting from a first side of the frame and attached to the rectangular frame by a fixing pin extending through the rectangular frame and the male portion, and a female portion on a second side of the frame opposite the first side, the female portion adapted to receive an elongate male portion from an adjoining hanging-scaffold panel;

the elongate male portion comprising a first semi-cylindrical section having a threaded hole and a first slot and a groove, an adjuster threadably engaging the threaded hole, a second semi-cylindrical section having a second slot wherein the first and second semi-cylindrical sections have different radii, wherein the first semi-cylindrical section is adapted to be received by the second semi-cylindrical section wherein the adjuster is adapted to abut the second semi-cylindrical section and is rotatable to force the first and second semi-cylindrical sections away from each other, wherein the first and second slots are elongate in an axial direction of the male and female portions;

a foot-board attached to the rectangular frame; and a fastening pin receivable in the first slot, the second slot and the female portion to connect the hanging-scaffold panel with the adjoining hanging-scaffold panel.

2. The hanging-scaffold panel of claim 1, wherein the rectangular frame is adapted to receive the foot-board with an upper surface of the foot-board approximately flush with the top of the rectangular frame.

3. A hanging scaffold comprising:

a plurality of panels, each panel attached to a structure with at least two hangers, each panel comprising:

a rectangular frame having a male portion projecting from a first side of the frame and attached to the rectangular frame by a fixing pin extending through the rectangular frame and the male portion, and a female portion on a second side of the frame opposite the first side, the female portion adapted to receive a male portion from an adjoining hanging-scaffold panel;

the male portion comprising a first half having a threaded hole and a first slot, an adjuster threadably engaging the threaded hole, and a second half having a second slot, wherein the adjuster is adapted to abut the second half and is rotatable to force the first and second halves away from each other;

a foot-board attached to the rectangular frame and approximately flush with the top of the rectangular frame;

a fastening pin receivable in the first slot, the second slot and the female portion to connect the hanging scaffold panel with the adjoining hanging scaffold panel; and at least one cover positioned over at least one connecting space defined between at least two adjacent panels, the at least one cover attached to each of the at least two adjacent panels with an arresting pin extending through the cover at an insertion opening, the at least one cover having at least one hanger slot and is adapted to receive at least one hanger.

* * * * *